US005107645A

United States Patent [19]

Beasley

[11] Patent Number: 5,107,645

[45] Date of Patent: Apr. 28, 1992

[54] METHOD AND APPARATUS FOR FORMING AN ALCOVE

[76] Inventor: Robert A. Beasley, 210 Blueberry Hill N.W., Cleveland, Tenn. 37312

[21] Appl. No.: 657,424

[22] Filed: Feb. 19, 1991

[51] Int. Cl.[5] ..... E04B 2/00

[52] U.S. Cl. ..... 52/204; 52/238.1; 52/455

[58] Field of Search ..... 52/204, 238.1, 242, 52/455, 786, 33, 27, 211

[56] References Cited

U.S. PATENT DOCUMENTS 2,308,169 1/1943 Grau ..... 52/455
4,177,612 12/1979 Tochihara ..... 52/238.1

*Primary Examiner*—David A. Scherbel
*Assistant Examiner*—Wynn E. Wood
*Attorney, Agent, or Firm*—Mason, Kolehmainen, Rathburn & Wyss

[57] ABSTRACT

A method and a kit is disclosed for forming an alcove in a rough opening for a standard door. The alcove is formed with a pair of converging side walls, disposed at an angle relative to the plane of the rough opening, which define a recessed door opening that is closed by an access door. The walls and the access door may be covered with mirrors forming a three-way mirror arrangement. In an alternative embodiment of the invention, the alcove is formed with a recessed wall relative to the plane of the door opening and one or more side wall doors. In order to facilitate construction of the alcove, a construction guide is disclosed which locates the positions of the side walls used to form the alcove. The guide as well as preformed structural members allow for relatively quick and easy construction of the mirrored alcove. Mirror panels are removably mounted for allowing relatively easy replacement of damaged mirrors.

14 Claims, 9 Drawing Sheets

114
112
108
108
118
116
54
118
116
56
110
108
36
78
108
34
110
78

54
110

110
54
108
36
78

FIG. 11
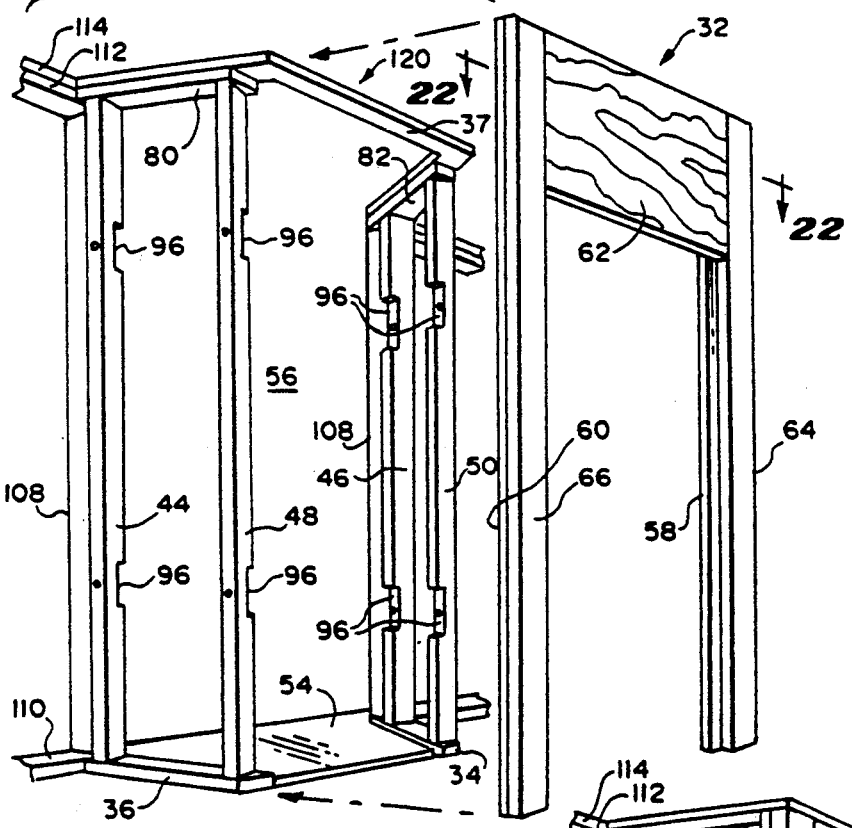
FIG. 22
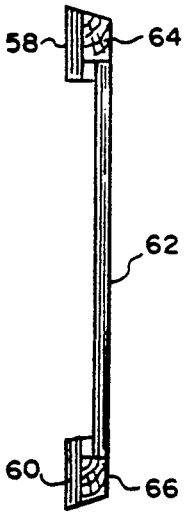
FIG. 13
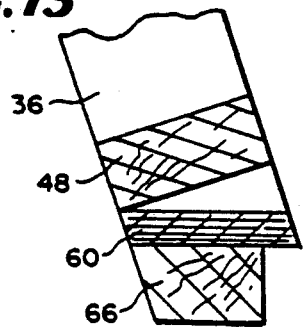
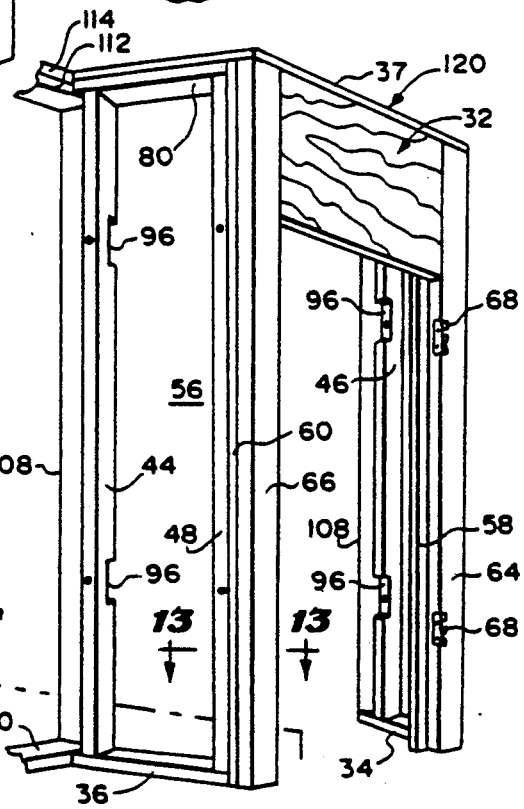
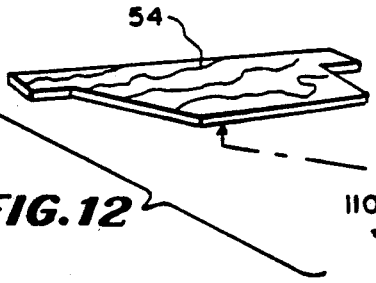
FIG. 12

METHOD AND APPARATUS FOR FORMING AN ALCOVE

BACKGROUND OF THE INVENTION

1. Technical Field

The present invention relates to construction and, more particularly, to a method and a kit for forming an alcove in a rough opening for a standard door which may be mirrored forming a mirrored viewing arrangement which includes a guide for facilitating construction.

2. Description of the Prior Art

Various structures are known in the art for providing mirrored viewing arrangements and dressing areas in retail stores and residential homes. Such structures are generally either provided as free standing structures or permanent structures and integrated into the room construction. Examples of free standing structures are disclosed in German Patentshrift 410070 and U.S. Pat. Nos. 831,549; 1,078,502 and 1,647,031. Such free standing structures are generally used in temporary or remodeling applications where sufficient floor space exists. However, such free standing structures are generally not used in new construction. In new construction, mirrored viewing areas are generally integrated into the construction. Moreover, due to the floor space requirements of such free standing structures, among other things, their use in residential housing is impractical.

Examples of permanent viewing area structures are disclosed in U.S. Pat. Nos. 226,362; 1,596,952; 2,807,192 and 2,949,059. Such permanent structures are either custom formed or adapted to be disposed in standard finished door openings. For example, U.S. Pat. No. 226,362 to Short discloses a custom formed viewing area. More specifically, Short discloses a walk-in type mirrored viewing area formed, for example, as a dressing room which includes four wall mirrors A, B, C and D. Mirrors A and C are permanently mounted, while mirrors B and D are pivotally mounted to provide simultaneous front and rear images of the subject within the viewing area. Although such an arrangement may provide a suitable viewing and dressing area, it requires a custom designed room, suitably dimensioned to carry the four mirrors.

Various other arrangements are known which do not require custom designed viewing rooms. Such arrangements are disclosed in U.S. Pat. Nos. 1,596,952; 2,807,192 and 2,949,059. These arrangements in general relate to specially designed doors that are adapted to be disposed in either a standard finished door opening or a standard finished closet door opening which include pivotally mounted mirror side panels, adapted to be swung out to a viewing position to provide a three-way mirror. When not in use, such pivotally mounted mirror side panels are placed in a normal position generally flush with the door to which they are attached.

More specifically, U.S. Pat. No. 1,596,952 to Smith discloses a reversible door, pivotally mounted within a standard finished door frame. The reversible door includes an auxiliary frame 14 which allows the door to pivot about its midpoint relative to the longitudinal axis, defined by the pivot points 22 and 23. The front side of the door is formed as a plain paneled door. The reverse side of the door is provided with two pivotally mounted mirrored side panels 29 and 30. The mirrored side panels are formed with half of the width of the door to allow them to be placed flush against the door and secured thereto when not in use. In operation, when three-way mirror viewing is desired, the door is reversed and the side panels 29 and 30 are swung out. After use, the side panels 29 and 30 are returned to their normal position and secured in place. The entire door is then pivoted to the original position. Such an arrangement would be cumbersome to use in addition to being relatively expensive. Moreover, due to the half width of the side panels 29 and 30, only relatively limited three-way mirror viewing is possible.

U.S. Pat. No. 2,807,192 to Von Berg discloses a mirrored viewing arrangement which includes three slidably mounted closet doors 13, 14 and 15 adapted to be disposed in a standard finished closet door opening. The center door 14 is provided with a rigidly attached mirror 17. The outside doors 13 and 15 are provided with pivotally mounted door panels 18 and 19. In operation, the three doors 13, 14 and 15 are placed in a position to close the closet door opening. The pivotally mounted mirror panels 18 and 19 are then swung out to the desired viewing position. After viewing, the mirror panels 18 and 19 are secured to the doors 13 and 15. In addition to being cumbersome to use, the above arrangement can only be used with relatively large closet door openings, for example, 45"-96" finished door openings. Such an arrangement could not be used with walk-in closets which generally have smaller finished door openings, such as, 32" to 36" door openings.

U.S. Pat. No. 2,949,059 to Solimine discloses a mirrored door arrangement, adapted to be disposed in a standard door opening to provide three-way mirror viewing on both sides of the door. More specifically, the door includes pivotally mounted mirror panels 19, 33 and 41 hinged in such a way to provide a three-way mirror on each side of the door as best shown in FIGS. 6 and 7 of the Solimine patent. Such an arrangement is relatively cumbersome to use. Additionally, such an arrangement is intended to be used in applications where three-way mirror viewing is desired in adjoining rooms. Accordingly, such an arrangement would not be practical in applications where three-way mirror viewing is only desired in a single room or multiple non-adjoining rooms.

The use of specially designed doors, such as disclosed in U.S. Pat. Nos. 1,596,952; 2,807,192 and 2,949,059 present problems in addition to those mentioned above. For example, swing-out door panels temporarily will require additional floor space not originally contemplated. Thus, when in the viewing position, such arrangements can affect the traffic patterns or placement of furniture, for example. Additionally, such specially designed doors would be relatively expensive.

SUMMARY OF THE INVENTION

It is an object of the present invention to provide a mirrored viewing arrangement which solves the problems of the prior art.

It is another object of the present invention to provide a mirrored viewing arrangement which does not require a custom designed viewing room.

It is yet a further object of the present invention to provide a mirrored viewing arrangement that is convenient to use.

It is yet another object of the present invention to provide a mirrored viewing arrangement that is adapted to be disposed in a rough opening for a standard door.

Briefly, the present invention relates to a method and a kit for forming an alcove in a rough opening for a standard door. The alcove is formed with a pair of converging side walls, disposed at an angle relative to the plane of the rough opening, which define a recessed door opening that is closed by an access door. The side walls and the access door may be covered with mirrors to form a three-way mirror arrangement. In an alternative embodiment of the invention, the alcove is formed with a recessed wall relative to the plane of the rough opening and one or more side wall doors. In order to facilitate construction of the alcove, a construction guide is disclosed which locates the positions of the vertical structural members for the side walls. The guide as well as preformed structural members allow for relatively quick and easy construction of the mirrored alcove. Mirror panels are removably mounted for allowing relatively easy replacement of damaged mirrors.

BRIEF DESCRIPTION OF THE DRAWING

These and other objects and advantages of the present invention will become readily apparent upon consideration of the following detailed description and attached drawing, wherein:

FIG. 11 is a perspective view of a door jamb subassembly disposed adjacent to the subassembly illustrated in FIG. 9;

FIG. 12 is similar to FIG. 11 and illustrates the assembly of the door jamb subassembly to the subassembly of FIG. 11 with the construction guide removed;

FIG. 13 is a partial plan sectional view along line 13—13 of FIG. 12;

FIG. 22 is a sectional view along line 22—22 of FIG. 11; and

DETAILED DESCRIPTION OF THE DRAWING

Figure 1:
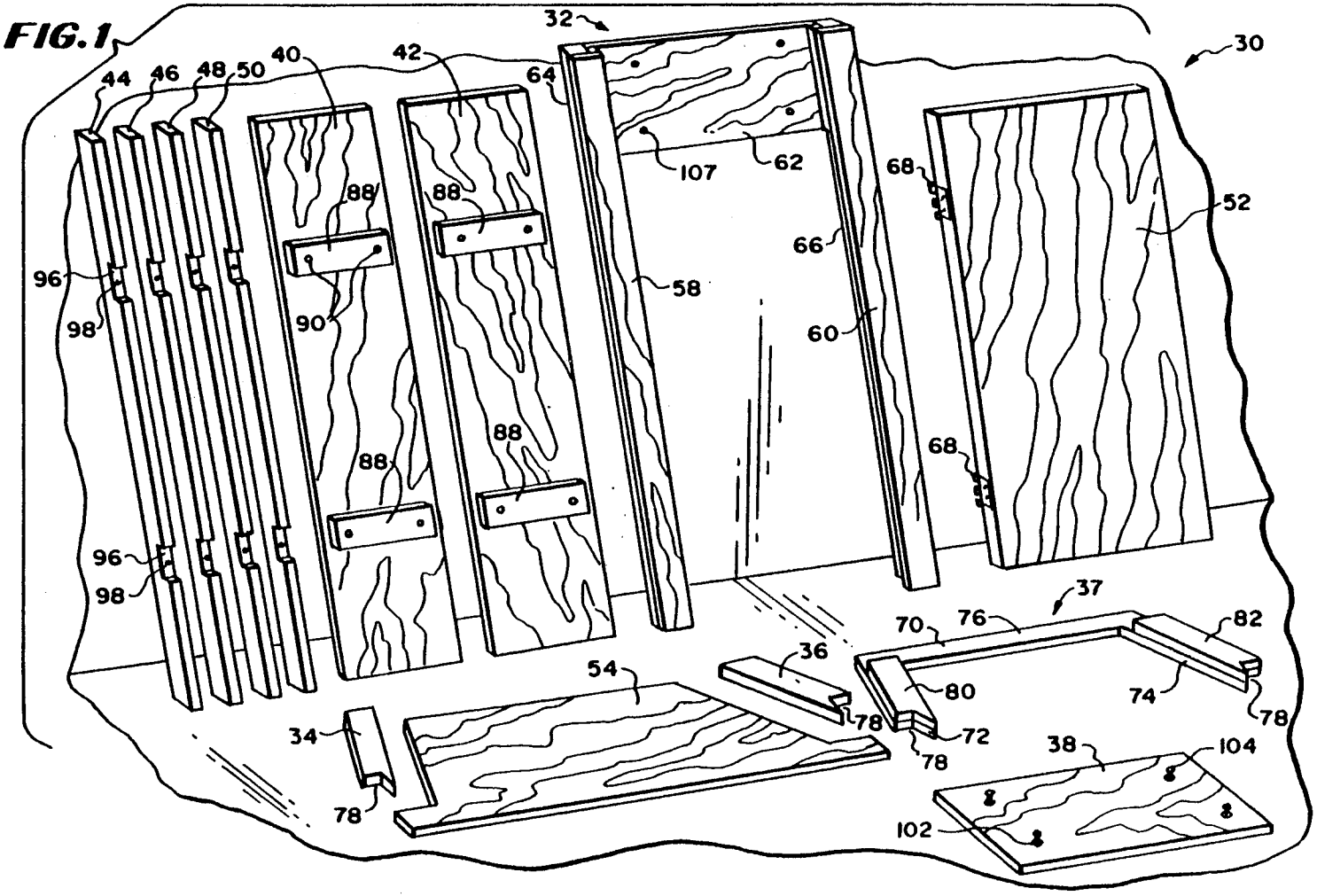
FIG. 1 is a perspective view of the components of the kit for forming an alcove in accordance with the present invention, including a construction guide.

An alcove in accordance with the present invention may be constructed with the components illustrated in FIG. 1 forming a kit, generally identified by the reference numeral 30. The kit 30 includes a door jamb subassembly 32, left and right base plates 34 and 36, respectively; a top plate subassembly 37, an above door mirror panel 38, two side mirror panel subassemblies 40 and 42, four vertical supports 44, 46, 48 and 50, an access door 52 and a construction guide 54. Mirrors may be secured to the above door panel 38, the side mirror panel subassemblies 40 and 42 and the access door 52 in a conventional manner to form a mirrored alcove as illustrated in FIGS 17, 18, 20 and 21. A construction guide 54 allows the alcove to be constructed in a rough opening 56 for a standard door relatively quickly and easily.

The door jamb subassembly 32 includes a pair of elongated spaced apart side jambs 58 and 60 formed with a length substantially equivalent to the length of the door opening 56. The side jambs 58 and 60 are sufficiently spaced apart to engage the door opening 56 and form side jambs for the access door 52. A top jamb 62 is assembled to the side jambs 58 and 60. The top jamb 62 is adapted to engage the top portion of the door opening 56. The side jambs 58 and 60 as well as the top jamb 62 may be formed from various materials, such as plywood or particle board.

A pair of vertical support members 64 and 66 having substantially the same length as the side jambs 58 and 60, formed from for example, 2 inch by 4 inch studs, are vertically aligned and fastened to a rear surface of the side jambs 58 and 60 adjacent oppositely disposed edges of the top jamb 62 as shown in FIG. 22. The vertical support members 64 and 66 are provided with door hinges 68 for mounting of the access door 52.

The top plate subassembly 37 includes a generally U-shaped member 70 defining a pair of depending legs 72 and 74 and an interconnecting portion 76. The depending legs 72 and 74 are disposed at a angle in range of 100 to 140 degrees and preferably 115 degrees relative to a longitudinal axis of the interconnecting portion 76. The angle controls the convergence of the mirrors carried by the side mirror panel subassemblies 40 and 42. In general, the more acute the angle the closer subject has to stand to the access door 52 for rear images to be viewed on the side mirrors.

The free ends of the depending legs 70 and 72 are provided with generally L-shaped notches 78. These notches 78 are adapted to receive the top portions of the vertical supports 44 and 46. Top plates 80 and 82, contoured to the shape of the depending legs 72 and 74, are attached to the depending leg portions 72 and 74 to form the top plate subassembly 37. The U-shaped member 70 may be integrally formed or formed from separate members from plywood or particle board.

The base plates 34 and 36 are formed to the general contour of the top plates 80 and 82. As will be discussed below, the base plates 34 and 36 are adapted to be vertically aligned with the top plates 80 and 82 such that their notches 78 receive the bottom portions of vertical supports 44 and 46. The base plates 34 and 36 as well as the top plates 80 and 82 may be formed from standard 2 inch by 4 inch studs.

Figure 16:
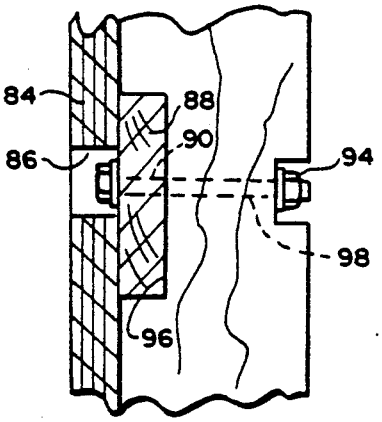
FIG. 16 is a partial perspective view along line 16—16 of FIG. 15.

The side mirror panel subassemblies 40 and 42 may be formed from a generally rectangular plate 84 having a plurality of apertures 86 and a plurality of horizontal support members 88, pre-drilled with apertures 90. The apertures 90 are preferably countersunk. As best shown in FIG. 16, the apertures 88 in the plate 84 may be through apertures or countersunk to allow mirrors to be mounted flush to the front of the plate 84. The apertures 88 are aligned with the apertures 90 in the horizontal support 88 to allow the horizontal supports 88 to be fastened to the plates 84 with elongated fasteners 92, for example, bolts and nuts 94 as shown in FIG. 16.

The vertical supports 44, 46, 48 and 50 may be provided with generally U-shaped notches 96 for receiving the horizontal supports 88 to allow the plates 84 to be disposed relatively flush thereagainst. Pre-drilled apertures 98 may be provided in the notches 96 for receiving an extending portion of fasteners 92. The nuts 94 allow the mirror panel subassemblies 40 and 42 to be removably secured to the vertical supports 44, 46, 48, and 50.

Figure 15:
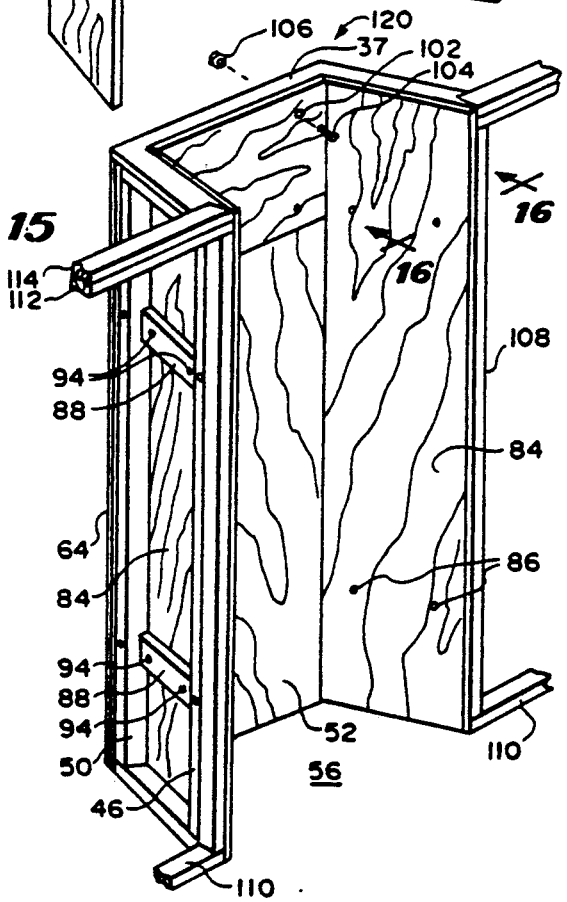
FIG. 15 is a perspective view of the assembly of the components illustrated in FIG. 14.

The above door panel 38 is also removably secured to allow for relatively quick and easy installation and removal. More specifically, the above door panel 38 is formed as a generally rectangular member, with a plurality of apertures 102 preferably countersunk for receiving fasteners 104. The fasteners 104 are adapted to be received in apertures 107 in the door jamb subassembly 32 and removably secured thereto with nuts 106 as shown in FIG. 15.

Figures 2, 3, 4:
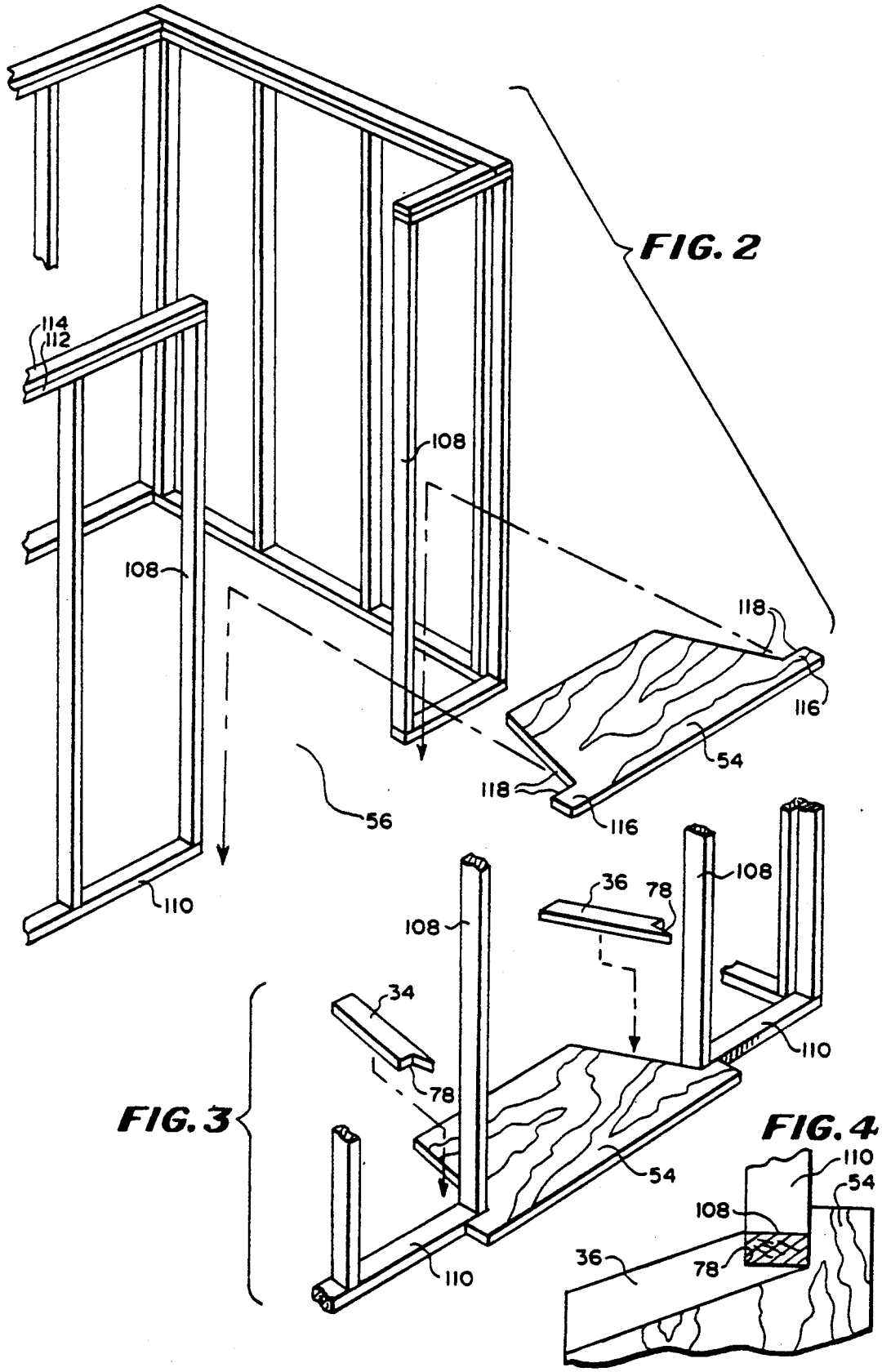
FIG. 2 is a partial perspective view of a studded wall illustrating a rough opening for a standard door and the placement of the construction guide in accordance with the present invention.
FIG. 3 is a partial perspective view of the area in FIG. 2, illustrating the construction guide in accordance with the present invention disposed in the rough opening and the placement of the base plates.
FIG. 4 is a partial plan view of the right base plate and the construction guide disposed in place in the rough opening of FIG. 2.

As described and illustrated, the kit 30 in accordance with the present invention is adapted to be installed in a rough opening 56 for a standard door, for example, 40 inches by 96 inches as shown in FIG. 2. The door opening 56 is defined by a pair of vertically aligned, spaced apart king studs 108, attached on the bottom to a sole plate 110 and a top plate 112 and cap plate 114 on top. The distance between the cap plate 114 and the floor determines the height of the rough opening 56, generally 96 inches, while the distance between the king studs 108 determines the width of the opening 56, generally 40 inches.

In new construction, the rough opening 56, as shown in FIG. 2, is adapted to receive the alcove in accordance with the present invention. In existing construction, some disassembly of a finished door opening (not shown) may be required before the kit 30 can be installed to create an alcove in accordance with the present invention. More specifically, finished door openings generally include a door jamb assembly and finish trim. Also a pair of trimmer studs (not shown) are generally disposed adjacent the king studs 108. A header (not shown) is generally disposed between the trimmer studs, generally at a height greater than 70 inches. Vertically disposed cripple studs (not shown) are normally disposed between, for example, the top plate 112 and the header plate. In such existing construction, it would be necessary to remove finish trim, the door jamb assembly, the trimmer studs, the header plate and cripple studs before installing the kit 30 in accordance with the present invention.

In order to facilitate construction of the kit 30 within the rough opening 56, the construction guide 54 is provided. The construction guide 54 is an irregular-shaped member formed in a generally trapezoidal shape with a pair of oppositely disposed locating ears 116. The locating ears 116 are formed as generally rectangular-shaped members defining oppositely disposed contact surfaces 118 for contacting the sole plate 110 adjacent the door opening 56. The construction guide 54 is suitably dimensioned to provide the correct angle for the base plates 34 and 36 relative to the plane of the door opening 56. More specifically, the left and right base plates 34 and 36 are disposed against the contact surfaces 118 so that L-shaped notches 78 engage the king studs 108. This positions the left and right base plates 34 and 36 such that they are disposed at the desired angle relative to the plane of the door opening 56. The left and right base plates 34 and 36 are then fastened to the floor with suitable fasteners. The construction guide 54 may then be removed at this point or at a later step in the construction process.

Figure 5:
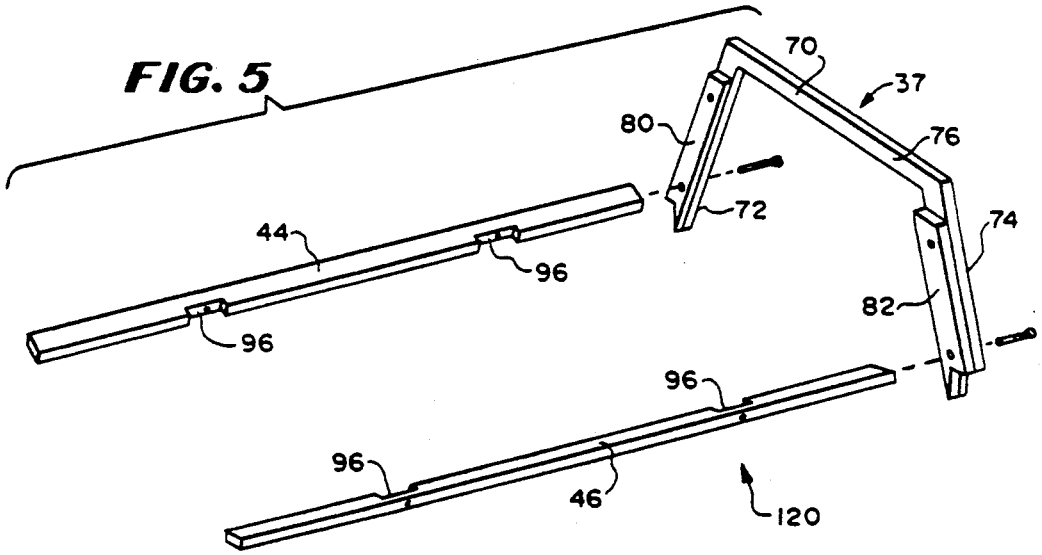
FIG. 5 is an exploded perspective view of a subassembly consisting of two vertical support members and a top plate subassembly in accordance with the present invention.
Figure 6:
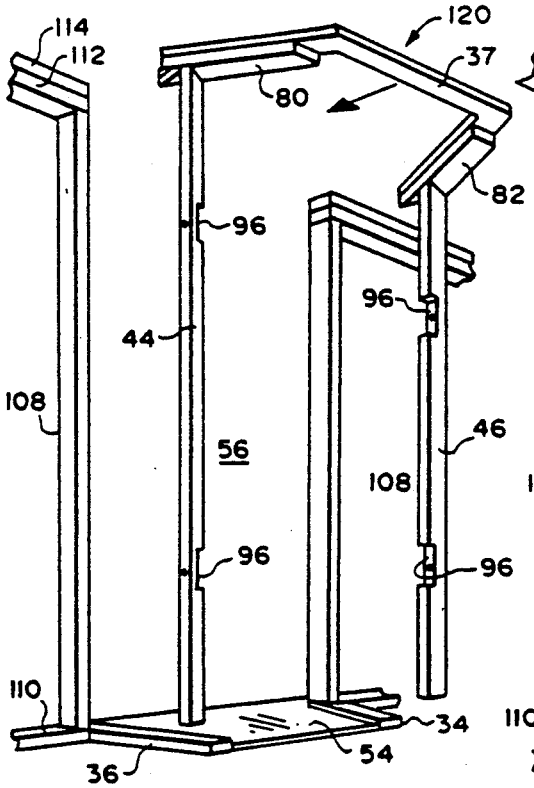
FIG. 6 is a perspective view of the subassembly of FIG. 5 disposed adjacent the rough door opening of FIG. 2, assembled with base plates.
Figure 7:
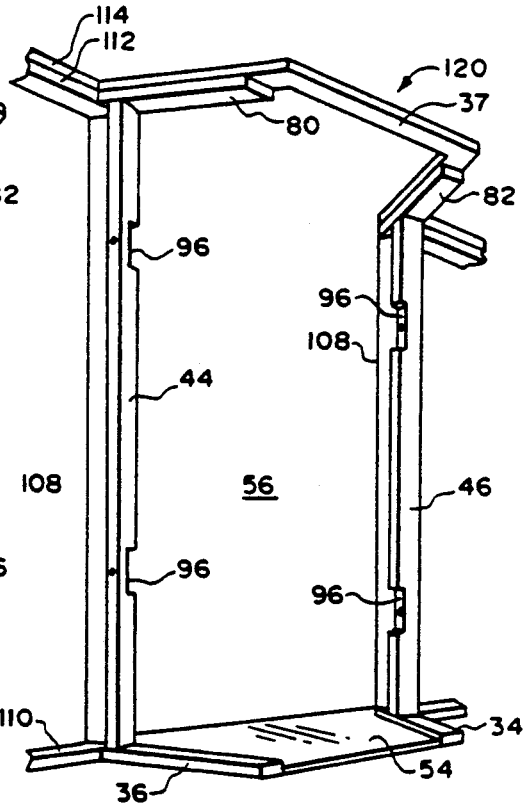
FIG. 7 is similar to FIG. 6 illustrating the subassembly of FIG. 5 in engagement with king studs in the rough opening of FIG. 2.
Figure 8:
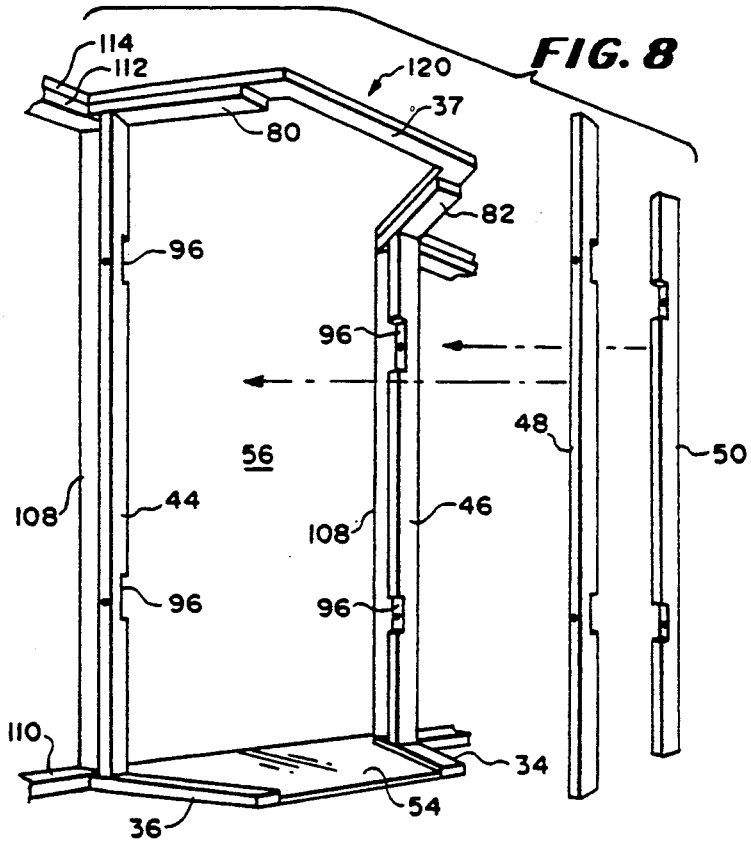
FIG. 8 is similar to FIG. 7 illustrating the rear vertical support members disposed adjacent the subassembly of FIG. 7.
Figure 9:
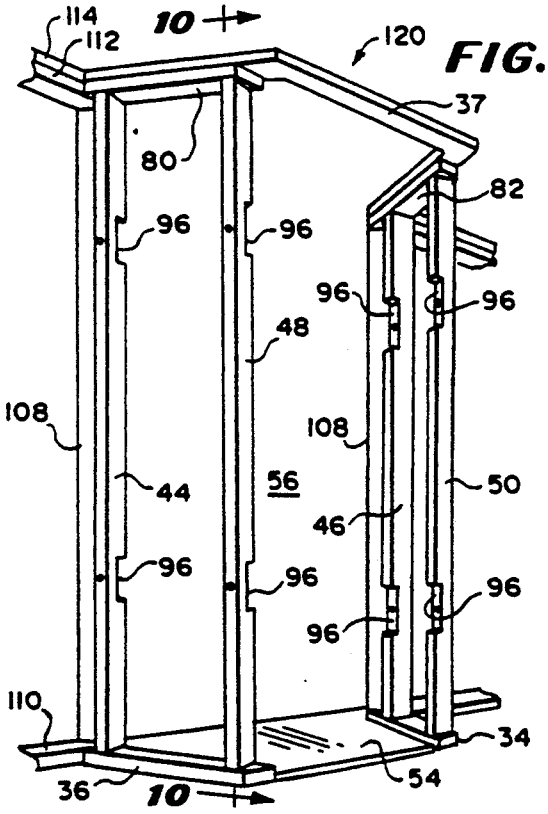
FIG. 9 is similar to FIG. 7 and illustrates the placement of the rear vertical support members in accordance with the present invention forming a subassembly.
Figure 10:
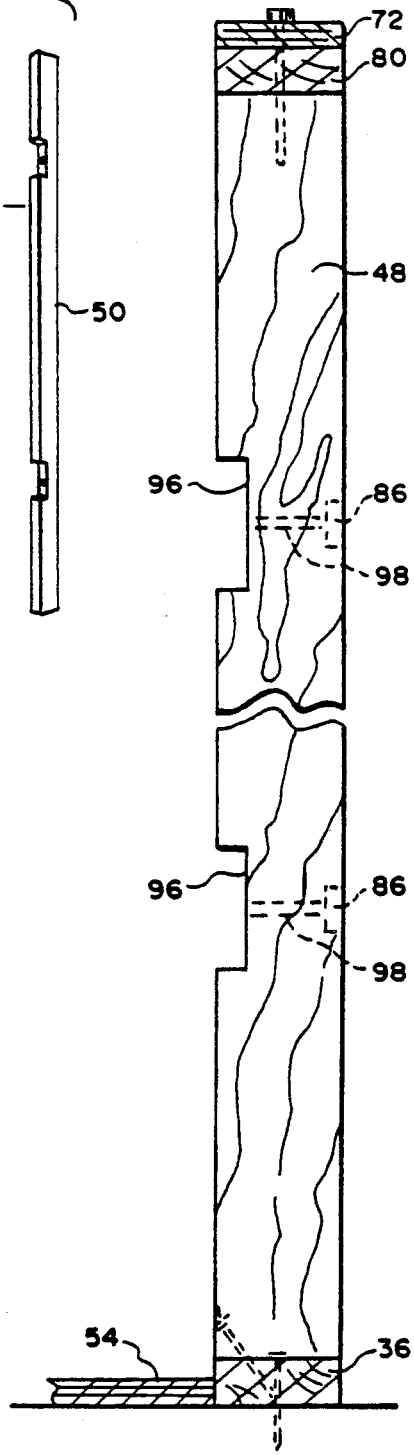
FIG. 10 is a cross-sectional view along line 10—10 of FIG. 9.

After the left and right base plates 34 and 36, respectively, have been fastened to the floor as shown in FIG. 4, the top plate subassembly 37 may be assembled to vertical support members 44 and 46 forming a subassembly 120 as shown in FIG. 5 by fastening the top portions of the vertical support members 44 and 46 to the top plates 80 and 82. In order to facilitate construction, the top plate subassembly 37 and the vertical supports 44, 46, 48, and 50 may be pre-drilled. The subassembly 120, may then be disposed within the rough opening 56 as shown in FIGS. 6 and 7 and fastened to the king studs 108 and to the left and right base plates 3 and 36. The vertical support members 48 and 50 are then attached to the left and right base plates 34 and 36 and to the top plates 80 and 82 a shown in FIGS. 9 and 10.

Figure 14:
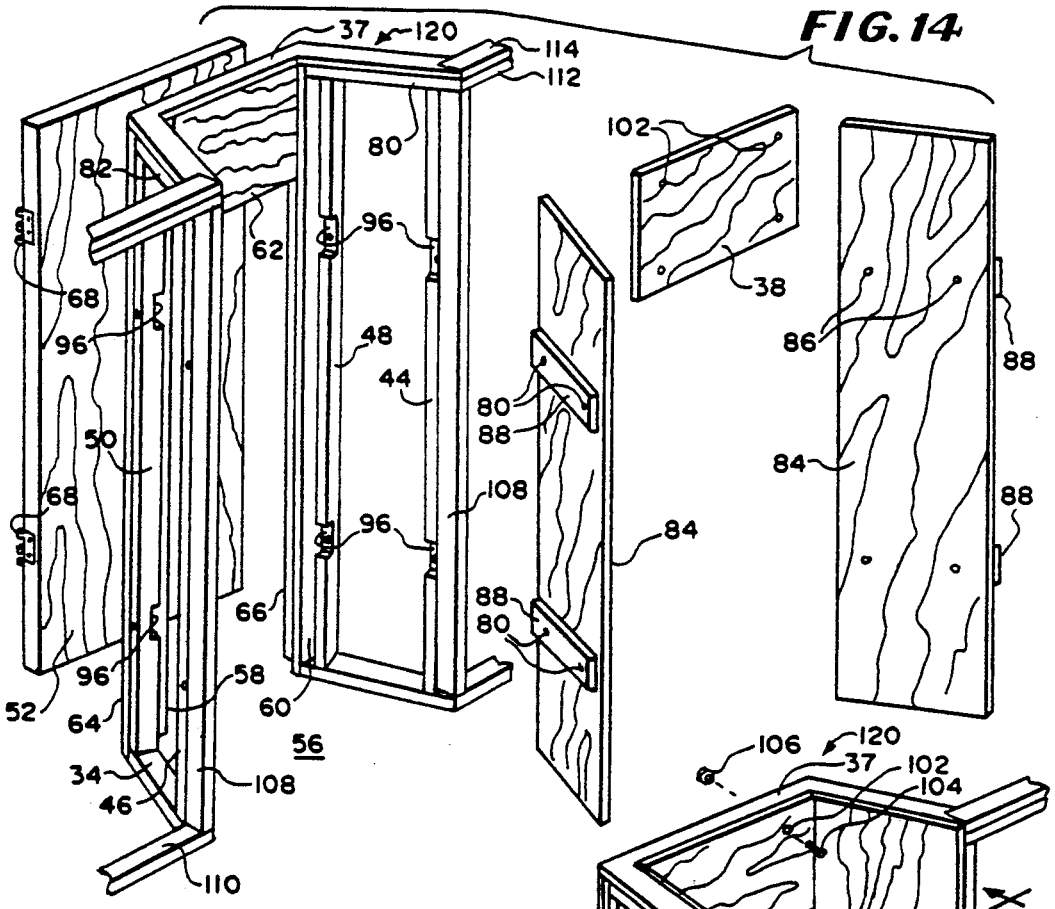
FIG. 14 is an exploded perspective view of the mirror side panel subassemblies, the above door panel and the access door relative to the subassembly illustrated in FIG. 12.
Figure 17:
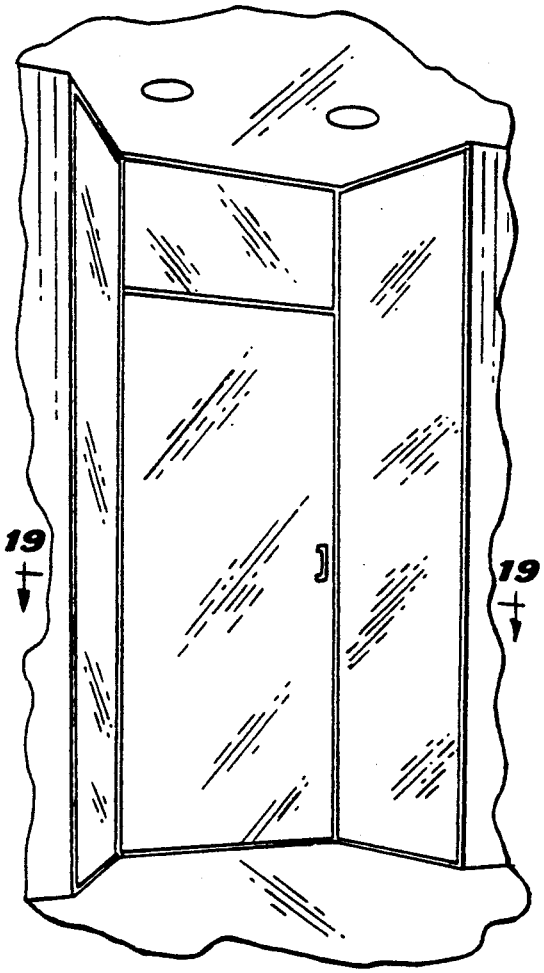
FIG. 17 is a perspective view of the mirrored alcove in accordance with the present invention illustrating the access door in a closed position.
Figure 18:
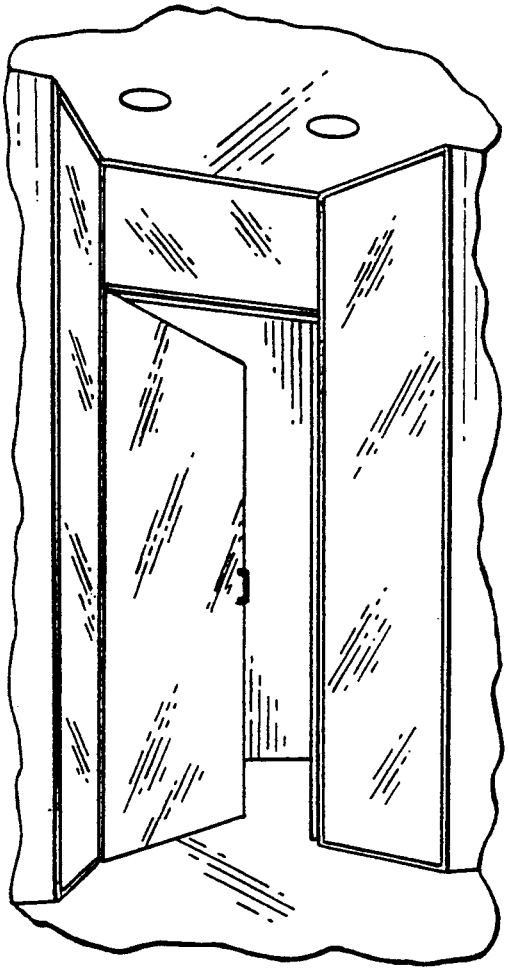
FIG. 18 is similar to FIG. 17 illustrating the access door in an open position.
Figure 19:
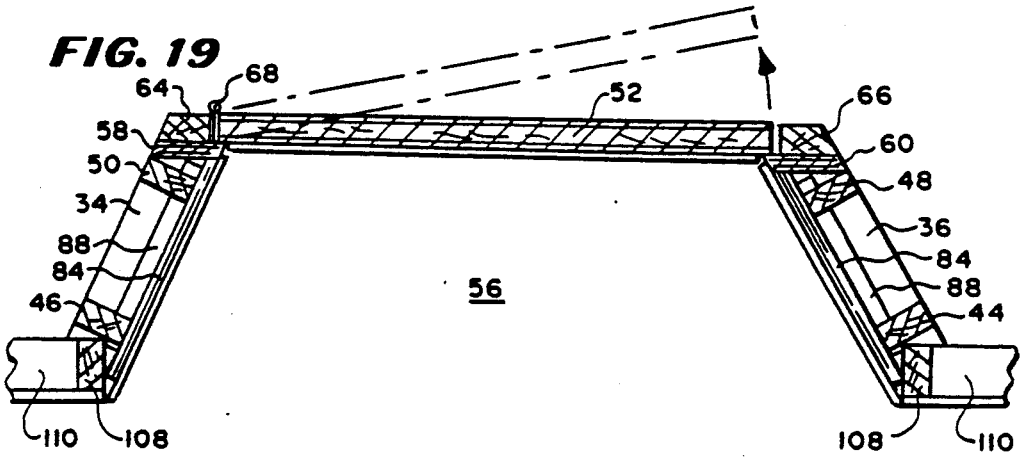
FIG. 19 is a partial sectional view along line 19—19 of FIG. 17.

After the four vertical support members 44, 46, 48, and 50 are assembled to the subassembly 120, the door jamb subassembly 32 is then disposed adjacent the vertical supports 48 and 50 and fastened thereto as shown in FIGS. 11, 12, and 13. The door jamb subassembly 32 provides a door jamb for the access door 52, recessed from the plane of the rough opening 56. After the door jamb subassembly 32 is securely fastened as shown in FIG. 14, the access door 52 complete with mirror may then be pivotally connected to the hinges 68 with standard hinge pins. The above door panel 38 as well as side mirror panel subassemblies 40 and 42 complete with mirrors may then be installed as discussed above to form the mirrored alcove as shown in FIGS. 17 and 18.

Figure 20:
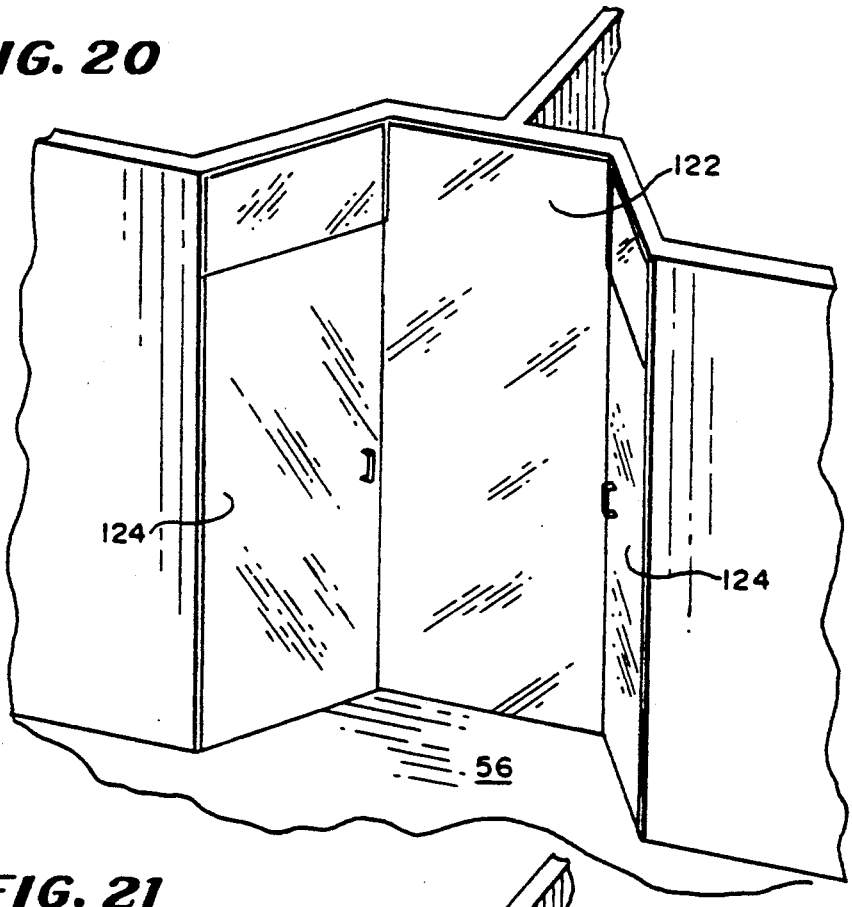
FIG. 20 is a perspective view of an alternate embodiment of the present invention illustrating the side access doors in a closed position.
Figure 21:
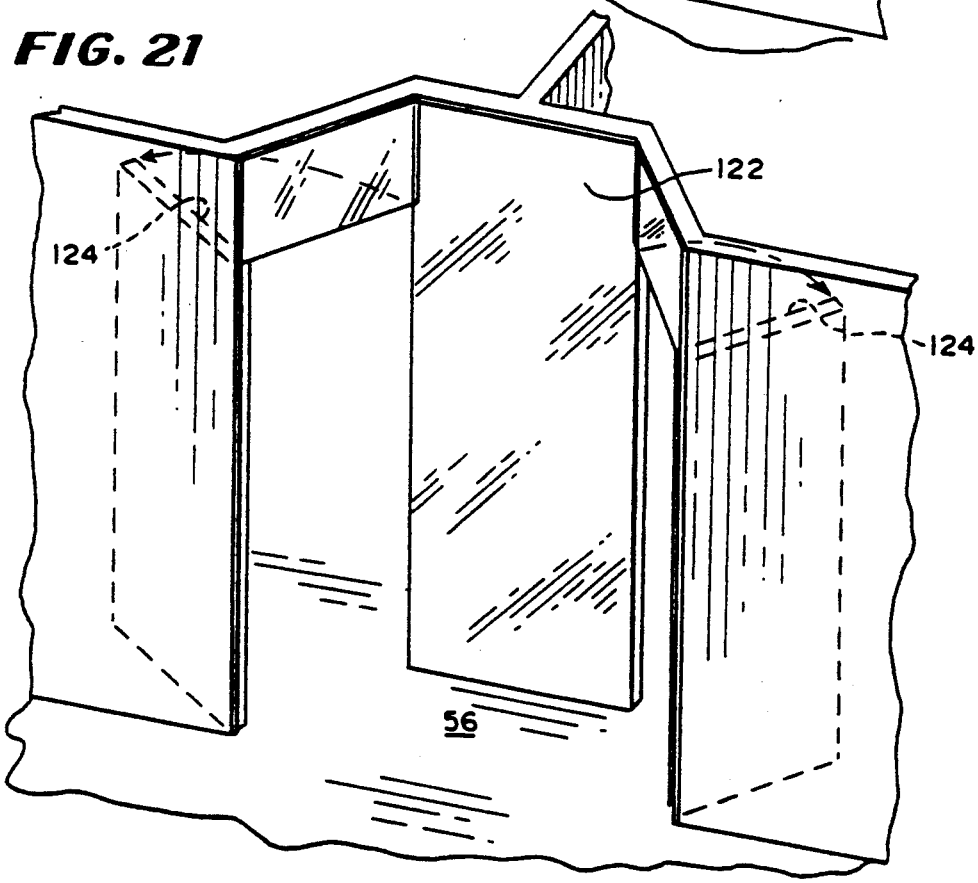
FIG. 21 is similar to FIG. 20 illustrating the side access doors of FIG. 20 in an open position.

An alternate embodiment of the invention is shown in FIGS. 20 and 21. This embodiment is generally contemplated for use in adjacent rooms, such as adjacent walk-in closets. In this embodiment, a wall panel 122 is recessed from the plane of the opening 56. Converging side panels 124 are provided as doors to allow access to adjoining closets. The door jamb subassemblies (not shown) as well as above door panels are provided for the side panels 124 and installed in the openings for the side panels 124 in a similar manner as discussed above.

Figure 23:
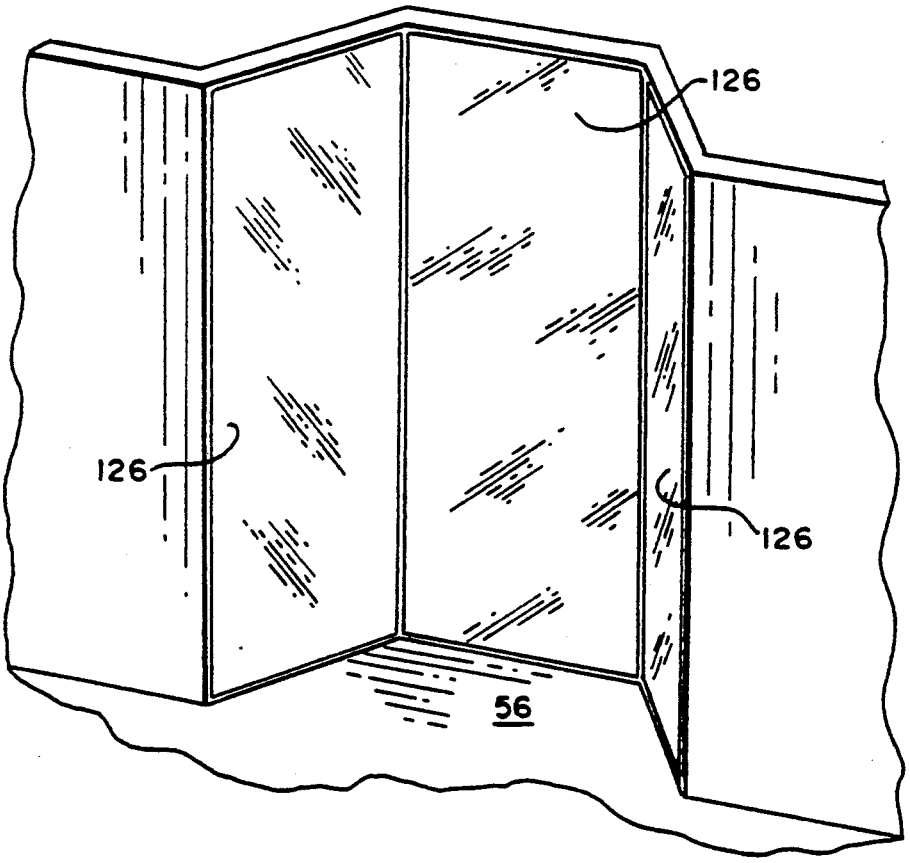
FIG. 23 is a perspective view of another alternate embodiment of the invention illustrating an alcove with three wall panels.

Another alternate embodiment is illustrated in FIG. 23. In this embodiment, an alcove in accordance with the present invention is formed with three wall panels 126.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A kit for building an alcove in a wall opening defined by a plurality of structural members, said alcove including a recessed portion generally spaced back and parallel relative to the plane of said wall opening and a pair of converging side wall portions disposed at predetermined angles relative to the plane of said wall opening, disposed between said opening and said recessed portion, comprising:

means removably engageable with said structural members defining said opening for guiding placement of said side wall portions at said predetermined angles, said guiding means adapted to be removed once said side wall portions are formed;

first means for forming said side wall portions; and second means for forming said recessed portion.

2. A kit for building an alcove in a wall opening defined by a plurality of structural members, said alcove including a recessed portion generally spaced back and parallel relative to the plane of said wall opening and a pair of converging side wall portions disposed at predetermined angles relative to the plane of said wall opening, disposed between said opening and said recessed portion, comprising:

means removably engageable with said structural members defining said opening for guiding placement of said side wall portions;

first means for forming said side wall portion; and second means for forming said recessed portion; wherein said second forming means includes means for pivotally mounting said recessed portion defining an access door.

3. A kit as recited in claim 1, wherein said first forming means includes means for rigidly mounting said side wall portions.

4. A kit as recited in claim 1, wherein said second forming means includes means for rigidly mounting said recessed portion.

5. A kit for building an alcove in a wall opening defined by a plurality of structural members, said alcove including a recessed portion generally spaced back and parallel relative to the plane of said wall opening and a pair of converging side wall portions disposed at predetermined angles relative to the plane of said door opening, disposed between said opening and said recessed portion, comprising:

means removably engageable with said structural members defining said opening for guiding placement of said side wall portions;

first means for forming said side wall portion; and second means for forming said recessed portion; wherein said first forming means includes means for pivotally mounting said side wall portions.

6. A kit for building an alcove in a predetermined rough opening for a standard door, said alcove comprising:

a recessed portion, generally spaced away from and parallel relative to the plane of said rough opening;

a pair of converging side wall portions disposed at predetermined angles relative to said recessed portion; and a construction guide adapted to be removably disposed in said rough opening for guiding the placement of said side wall portions at said predetermined angles, said construction guide adapted to be removed once said side wall portions are formed.

7. A kit as recited in claim 6, further including a plurality of mirror panels and means for securing said mirror panels to said recessed portion and said side wall portions to form a mirrored alcove.

8. A kit for building an alcove in a predetermined rough opening for a stand door, said alcove comprising:

a recessed portion, generally spaced away from and parallel relative to the plane of said rough opening;

a pair of converging side wall portions disposed at predetermined angles relative to said recessed portion;

a construction guide adapted to be removably disposed in said rough opening for guiding the placement of said side wall portions; and means for pivotally mounting said recessed portion.

9. A kit for building an alcove in a predetermined rough opening for a standard door, said alcove comprising:

a recessed portion, generally spaced away from and parallel relative to the plane of said rough opening;

a pair of converging side wall portions disposed at predetermined angles relative to said recessed portion; and a construction guide adapted to be removably disposed in said rough opening for guiding the placement of said side wall portions; and means for pivotally mounting one of said side wall portions.

10. A kit as recited in claim 9, further including means for pivotally mounting the other of said wall portions.

11. A kit for building an alcove in a predetermined rough opening for a standard door, said alcove comprising:

a recessed portion, generally spaced away from and parallel relative to the plane of said rough opening;

a pair of converging side wall portions disposed at predetermined angles relative to said recessed portion; and a construction guide adapted to be removably disposed in said rough opening for guiding the placement of said side wall portions; wherein aid predetermined rough opening is substantially equivalent to 40 inches.

12. A kit as recited in claim 6, wherein said predetermined angle is in the range between 100 and 140 degrees.

13. A kit as recited in claim 12, wherein said predetermined angle is substantially equivalent to 115 degrees.

14. A kit for building an alcove in a predetermined rough opening for a standard door, said alcove comprising:

a recessed portion, generally spaced away from and parallel relative to the plane of said rough opening;

a pair of converging side wall portions disposed at predetermined angles relative to said recessed portion; and a construction guide adapted to be removably disposed in said rough opening for guiding the placement of said side wall portions; wherein said construction guide is formed as a generally trapezoidal-shaped member having a pair of oppositely disposed ears for locating said construction guide relative to said rough opening.

* * * * *